US008616591B2

(12) United States Patent
Parker

(10) Patent No.: US 8,616,591 B2
(45) Date of Patent: Dec. 31, 2013

(54) PUSH PLATE ASSEMBLY

(75) Inventor: Stuart Kenneth Parker, Portsmouth (GB)

(73) Assignee: Surelock McGill Limited, Wokingham (GB)

( * ) Notice: Subject to any disclaimer, the term of this patent is extended or adjusted under 35 U.S.C. 154(b) by 361 days.

(21) Appl. No.: 12/449,118

(22) PCT Filed: Jan. 24, 2008

(86) PCT No.: PCT/GB2008/000254
§ 371 (c)(1),
(2), (4) Date: Jul. 23, 2009

(87) PCT Pub. No.: WO2008/090352
PCT Pub. Date: Jul. 31, 2008

(65) Prior Publication Data

US 2010/0018268 A1 Jan. 28, 2010

(30) Foreign Application Priority Data

Jan. 24, 2007 (GB) ..... 0701361.8

(51) Int. Cl.
*E05B 65/10* (2006.01)
*E05B 3/00* (2006.01)

(52) U.S. Cl.
USPC .... 292/92; 292/336.3; 292/244; 292/DIG. 65

(58) Field of Classification Search
USPC ..... 292/92–94, 336.3, 173, 24, 347, 348, 292/352, 354, DIG. 31, DIG. 46, DIG. 60, 292/122, 169, 169.18, 197, 244, 358, 359, 292/DIG. 26, DIG. 62, DIG. 65; 70/92, 149, 70/462, DIG. 42, 465
See application file for complete search history.

(56) References Cited

U.S. PATENT DOCUMENTS

| | | | | |
|---|---|---|---|---|
| 1,843,143 | A * | 2/1932 | Rymer | 70/469 |
| 2,098,776 | A * | 11/1937 | Edwards | 292/93 |
| 3,097,007 | A * | 7/1963 | Eichacker et al. | 292/92 |

(Continued)

FOREIGN PATENT DOCUMENTS

| | | | |
|---|---|---|---|
| EP | 1 318 257 | A | 6/2003 |
| EP | 1 626 143 | A | 2/2006 |
| ES | 2 156 646 | A1 | 7/2001 |
| GB | 2 429 746 | A | 3/2007 |

OTHER PUBLICATIONS

International Search Report, PCT/GB2008/000254, date of mailing Mar. 25, 2008.
UK Search Report, GB0701361.8, date of mailing Apr. 27, 2007.

*Primary Examiner* — Carlos Lugo
*Assistant Examiner* — Alyson M Merlino
(74) *Attorney, Agent, or Firm* — Hamilton, Brook, Smith & Reynolds, P.C.

(57) ABSTRACT

A push plate assembly (10) that may be used for driving a bolting mechanism is disclosed. The push plate assembly (10) may be included as part of a push pad assembly or panic bar assembly, such as may be fitted to single or multipoint bolt mechanisms, for example, those fitted to emergency exit doors. The push plate assembly comprises a housing (32), a push plate (36), a slide plate (45) and a drive cam (55). The drive cam (55) is arranged to rotate within the housing so as to rotationally drive a bolt mechanism.

25 Claims, 6 Drawing Sheets

(56) References Cited

U.S. PATENT DOCUMENTS

| | | | | | |
|---|---|---|---|---|---|
| 3,257,138 | A | * | 6/1966 | Russell et al. | 292/336.3 |
| 3,266,829 | A | * | 8/1966 | Yoe et al. | 292/92 |
| 3,287,054 | A | * | 11/1966 | Russell et al. | 292/336.3 |
| 3,894,759 | A | * | 7/1975 | Balducci | 292/92 |
| 3,897,092 | A | * | 7/1975 | Atkins | 292/92 |
| 3,993,335 | A | * | 11/1976 | Schmidt | 292/21 |
| 4,052,092 | A | * | 10/1977 | Bergen | 292/172 |
| 4,725,085 | A | * | 2/1988 | Hu et al. | 292/172 |
| 4,779,909 | A | * | 10/1988 | Hennessy | 292/166 |
| 4,974,883 | A | * | 12/1990 | Jans | 292/169 |
| 4,988,136 | A | * | 1/1991 | Gressett, Jr. | 292/336.3 |
| 4,997,220 | A | * | 3/1991 | Jans | 292/169.16 |
| 5,072,977 | A | * | 12/1991 | Millman et al. | 292/336.3 |
| 5,083,822 | A | * | 1/1992 | Mangin et al. | 292/21 |
| 5,088,778 | A | * | 2/1992 | Lin | 292/336.3 |
| 5,088,786 | A | * | 2/1992 | Linder | 292/92 |
| 5,123,683 | A | * | 6/1992 | Solovieff | 292/172 |
| 5,513,510 | A | * | 5/1996 | Solovieff et al. | 70/472 |
| 5,611,227 | A | * | 3/1997 | Solovieff | 70/472 |
| 5,690,372 | A | * | 11/1997 | Jans | 292/169 |
| 6,178,795 | B1 | * | 1/2001 | Hsueh | 70/472 |

* cited by examiner

PUSH PLATE ASSEMBLY

This application is the U.S. National Stage of International Application No. PCT/GB2008/000254, filed Jan. 24, 2008, which designates the U.S., published in English, and claims priority under 35 U.S.C. §§119 or 365(c) to Great Britain Application No. 0701361.8, filed Jan. 24, 2007.

FIELD OF THE INVENTION

The present invention relates to a push plate assembly, for example, to drive a bolting mechanism. The push plate assembly may be included as part of a push pad assembly or panic bar assembly. In particular, but not exclusively, the invention relates to a push plate assembly that may be fitted to multi-point or single point bolt mechanisms such as those fitted on emergency exit doors.

DISCUSSION OF THE PRIOR ART

Commonly, multi-point or single point bolting mechanisms are used on emergency exit doors of buildings, as shown in FIG. 1. These bolting mechanisms often include a panic bar 2 for release of the bolting mechanism 4 during an emergency, as shown in FIG. 1. The panic bar 2 provides a means of releasing the bolting mechanism 4 that is easy and quick to operate. In emergency situations, the door must be unbolted rapidly to allow persons to escape through the door way. If the bolt release mechanism uses a door handle, the persons trying to escape must first locate the door handle, and then turn it in the correct direction to open the door. A panic bar requires less time to locate as it is generally of the same width of the door, and merely requires a pushing motion towards the door to release the bolting mechanism. This can be especially useful in situations where visibility is poor, such as in smoke filled buildings. Moreover, a panic bar can be easily operated by young children and the elderly.

In some locations, a push pad is sufficient. This also requires a pushing motion to release the bolting mechanism, but the actuator is smaller and limited to a pad rather than a bar.

Push pad and panic bar bolt release mechanisms are fitted to bolting mechanisms on doors and other openings, and are required to be tailored to meet the opening direction of the door. For example, left hand and right hand opening doors will require bolting mechanisms and push pads/panic bars that are also left handed or right handed to match the door. Prior art systems require different handed bolting mechanisms and push pad/panic bars, or at least a number of additional components to allow conversion of a dual handed unit to operate in both right and left handed configurations.

As identified above, push pads and panic bars should be easy to operate by everyone, including the elderly, disabled and young children. Hence, any reduction in the force required to operate the push pad or panic bar is desirable. Such reductions in operating force, must not be achieved at the expense of reduced reliability.

SUMMARY OF THE INVENTION

The present invention seeks to overcome problems of the prior art. Accordingly, the present invention provides a push plate assembly for rotationally driving a bolt mechanism, the push plate assembly comprising: a housing, a push plate rotatably coupled to the housing so as to rotate when pushed towards the housing, a slide plate mounted within the housing to slide when driven by rotation of the push plate, and a drive cam arranged to rotate within the housing when driven by the slide plate so as to drive the bolt mechanism.

The push plate may comprise a tang or shoulder adapted to bear against a surface of the slide plate so as to drive the slide plate on rotation of the push plate.

The drive cam may be arranged to rotate within the slide plate and bear upon a cammed surface of an aperture within the slide plate. The cammed surface may be a flat surface of the slide plate upon which the cam bears.

The axis of rotation of the drive cam may be perpendicular to the direction of sliding of the slide plate.

The axis of rotation of the drive cam may pass through or intersect the plane of the slide plate.

The rotation of the push plate may be about an axis substantially perpendicular to the axis of rotation of the drive cam.

The push plate may be hinged by a pin passing through one or more holes in each of the housing and the push plate.

The drive cam may include an aperture adapted to receive a shaft or spindle for driving the bolt mechanism. The aperture may be adapted to receive the shaft or spindle at two orientations, the two orientations arranged for reversible drive of a bolt mechanism. By reversible we mean that the assembly may be reconfigured to operate on either a left hand opening door or a right hand opening door. The aperture may be comprised of two square apertures offset by an angle about the rotation axis of the drive cam.

The push plate may be rotatably coupled to the housing by a pivot comprising a first bearing. The first bearing may be a sleeve bearing. The bearing reduces the force required to actuate the push pad and also may also increase the life of the assembly.

The drive cam may be rotatably coupled to the housing by a bearing assembly.

The drive cam may comprise a crank pin arranged to be driven by the slide plate to rotate the drive cam. The crank pin may be rotatably coupled to the drive cam via a bearing.

Advantageously, less than 45° rotation of the push bar may provide greater than 45° of rotation of a shaft of the bolt mechanism.

There is also provided a push pad assembly, and a panic bar assembly comprising the push plate assembly. The push pad assembly includes the push plate assembly and a push bar. The panic bar assembly includes the push plate assembly and a bar for pushing. In addition, a bolting mechanism may comprise the push plate assembly, push pad assembly, or panic bar assembly. The bolting mechanism may comprise one or more bolts slideable from a thrown position to a retracted position by pressing the push plate.

BRIEF DESCRIPTION OF THE DRAWINGS

Embodiments of the present invention will now be described by way of example with reference to the accompanying drawings in which.

DETAILED DESCRIPTION OF THE PREFERRED EMBODIMENTS

Preferred embodiments of the push plate assembly of the present invention are a push pad assembly, and panic bar assembly.

Figure 1:
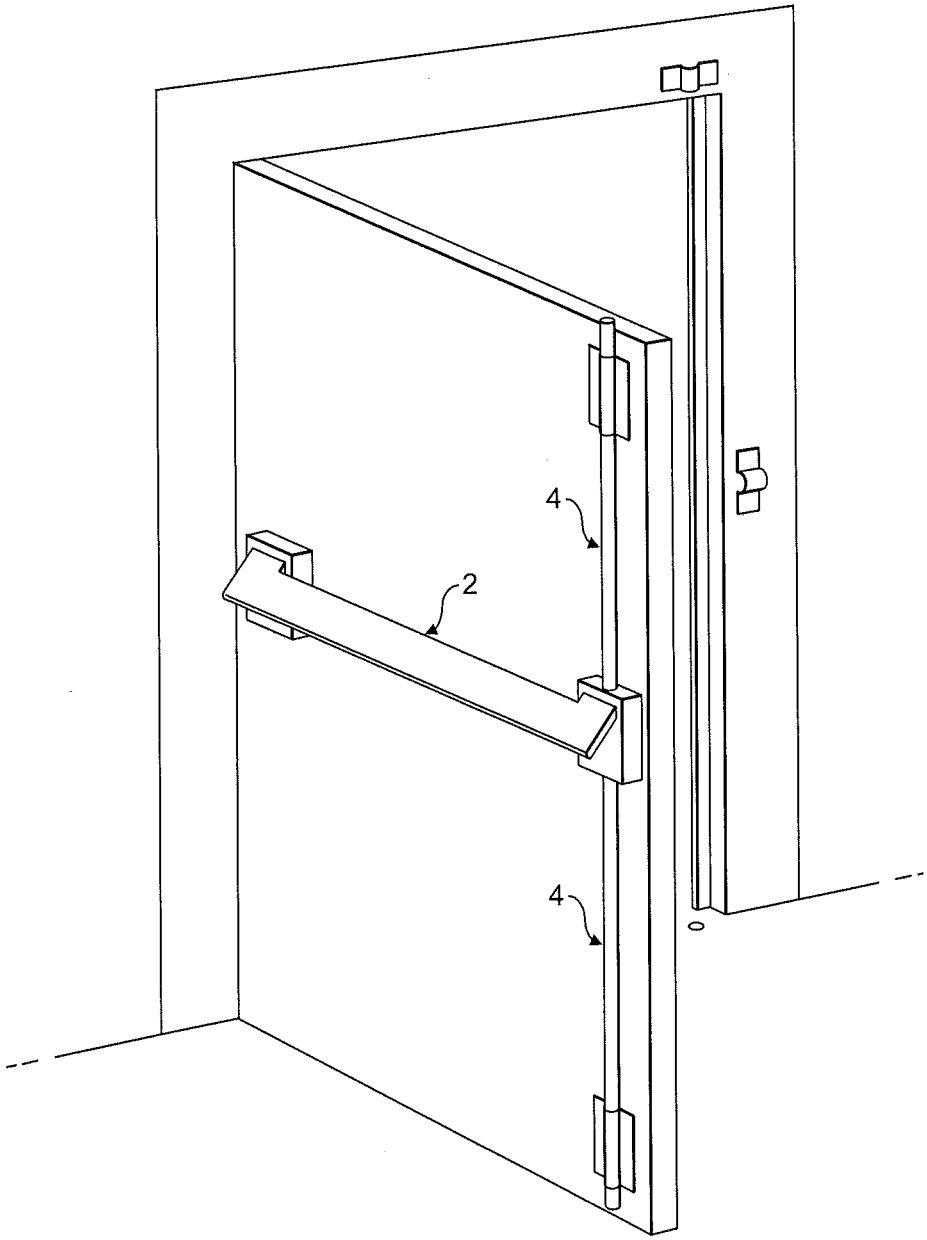
FIG. 1 PRIOR ART
FIG. 1 shows a panic bar of the prior art mounted to a door.
Figure 2:
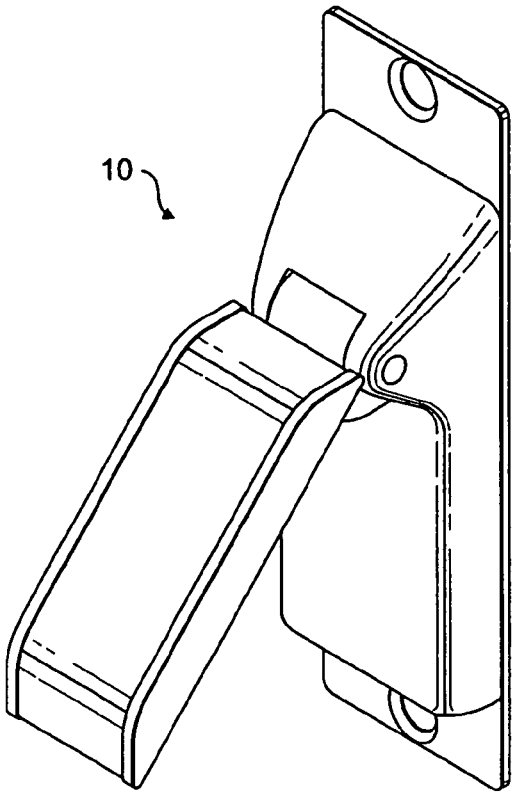
FIG. 2 shows a perspective view of the push pad assembly of the present invention.
Figure 3:
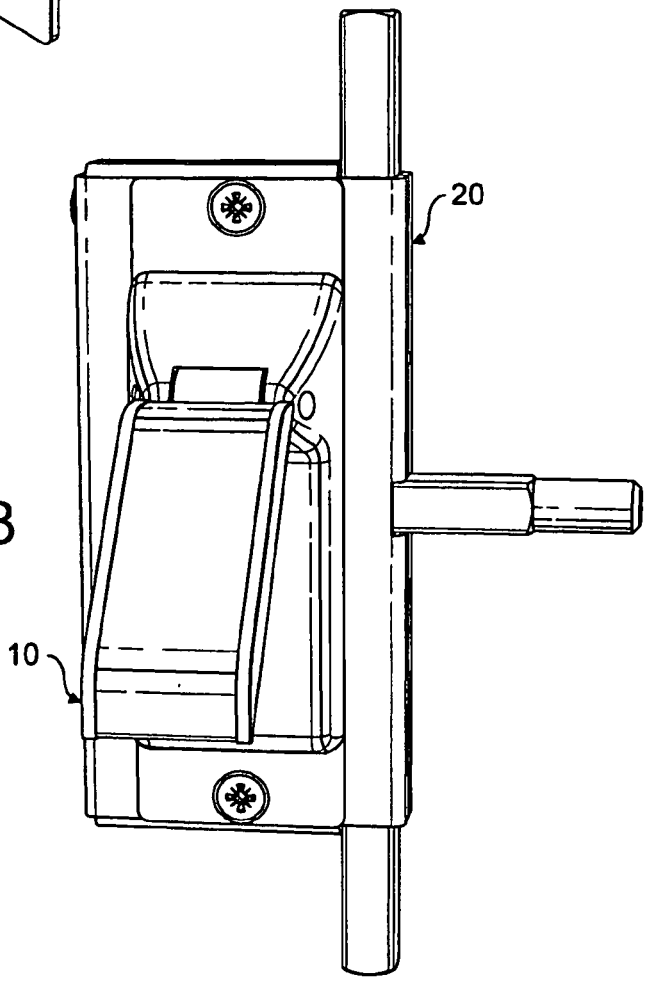
FIG. 3 shows the push pad of FIG. 2 fitted to a multipoint bolting mechanism.

FIG. 2 shows the push pad assembly 10. FIG. 3 shows the push pad assembly 10 mounted to a multipoint bolting mechanism 20. The multipoint bolting mechanism 20 is shown as an example. The push pad may be used with other bolting mechanisms and in particular, single point bolting mechanisms.

Figure 4:
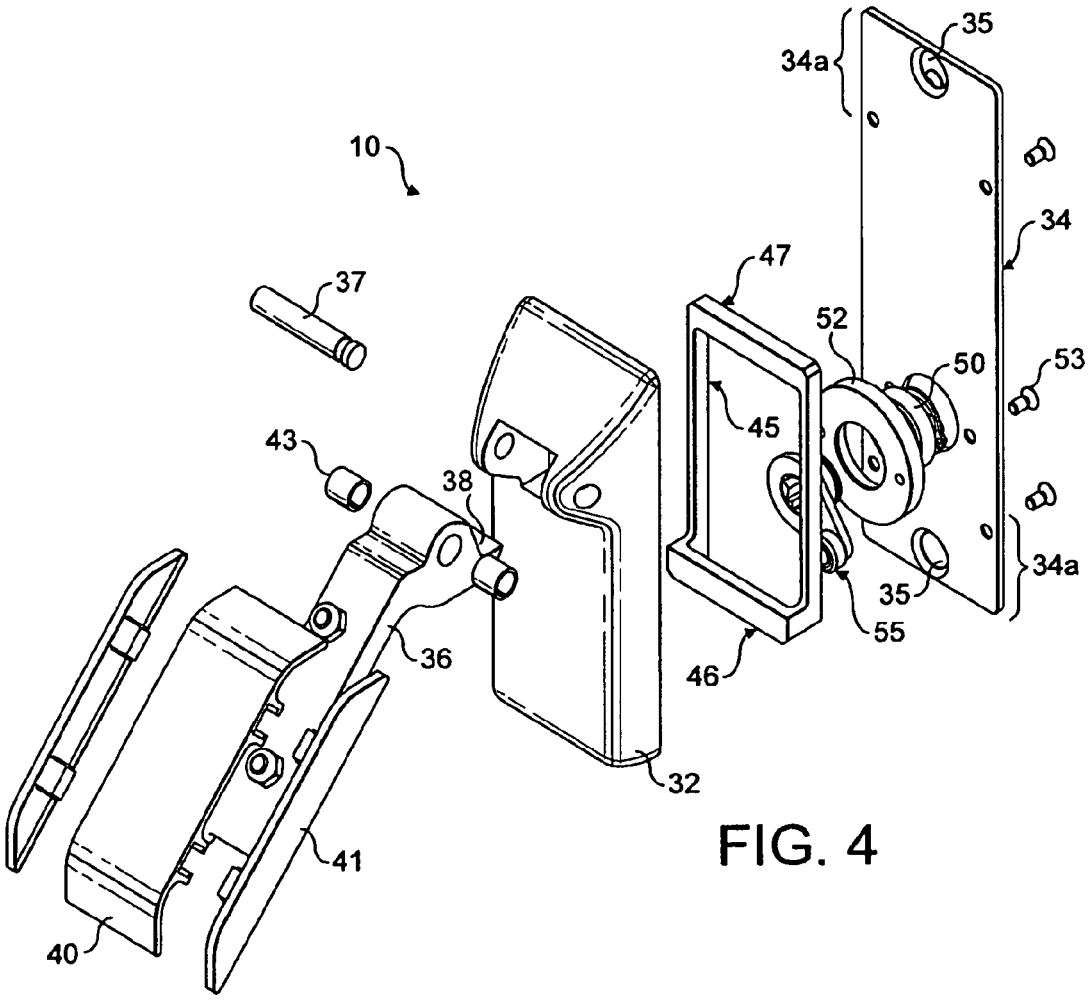
FIG. 4 is an exploded view of the push pad assembly of FIG. 2.

FIG. 4 shows an exploded view of the push pad assembly 10. The push pad assembly 10 comprises a housing 32 together with a housing backplate 34. In the embodiment shown, the housing backplate 34 is longer than the housing 32. The parts 34*a* extending beyond the end of the housing 32 include mounting holes 35 for mounting the push pad assembly 10 to the bolting mechanism, as shown in FIG. 3. Alternative embodiment do not include the parts 34*a*, and a different mounting configuration may be used.

The push pad assembly 10 further comprises a push pad 36 pivotally coupled to the housing by pin 37. The push pad 36 is extended in two directions from the pivot. That is, the push pad 36 extends away from the housing to provide a means for operating the push pad assembly. The push pad 36 also comprises a drive shoulder 38 which extends into the housing 32. The push pad 26 may also comprise various front 40 and side 41 cover plates. These may be manufactured or painted in a colour that is readily apparent to people nearby. Commonly, green is used to indicate emergency exits. The cover plates may be manufactured from plastic or other durable material.

As mentioned above, the push pad 36 may be mounted to the housing 32 with a pin 37 to provide a pivotable coupling. Additionally, sleeve bearings 43 may be used between the pin 37 and housing 32 to reduce the frictional force required for rotation of the push pad. The reduced friction may also help to increase the lifetime of the push pad assembly 10.

There is also provided a slide plate 45 in the housing. In the present embodiment, the slide plate is formed in a rectangular ring, the bottom side 46 extending out of the plane of the ring. The top side 47 of the ring is located above, but resting on, the drive shoulder 38 of the push pad 36.

The backplate 34 has attached thereto a bearing assembly 50 enclosed by support ring 52. The support ring 52 is fixed to the backplate 34 by screws 53. The bearing assembly 50 holds the drive cam 55, while allowing rotation of the cam about an axis through the centre of the bearing assembly. The drive cam 55 is a push fit in the bearing assembly 50, and retained by a circlip (not shown).

Figure 5:
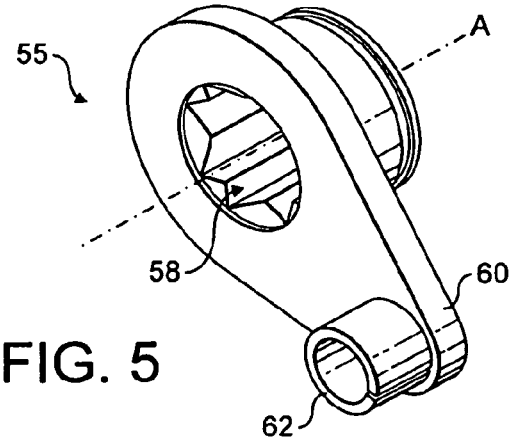
FIG. 5 is a perspective view of the drive cam of the push pad assembly of FIG. 2.

FIG. 5 shows the drive cam 55 in more detail. The drive cam 55 is comprised of an aperture 58, a cam lobe 60, and a crank pin 62 mounted on the cam lobe 60. When the push pad assembly 10 is fitted to a bolting mechanism, the aperture 58 holds a spindle for driving the lock mechanism. Such spindles usually have a square cross-section, and hence the aperture 58 may be square. Additionally, the aperture 58 may be comprised of two offset square apertures. In such a case, the two apertures are centred on a common axis A, but offset by an angle. The offset apertures are used when the push pad assembly is configured for reversible use. This is described in more detail below.

The crank pin 62 mounted on the cam lobe 60 includes bearings to allow the curved outer surface of the crank pin 62 to rotate.

In the push pad assembly 10, the crank pin 62 of the drive cam 55 rests against the upper surface of the bottom side 46 of the slide plate 45.

Figure 6A:
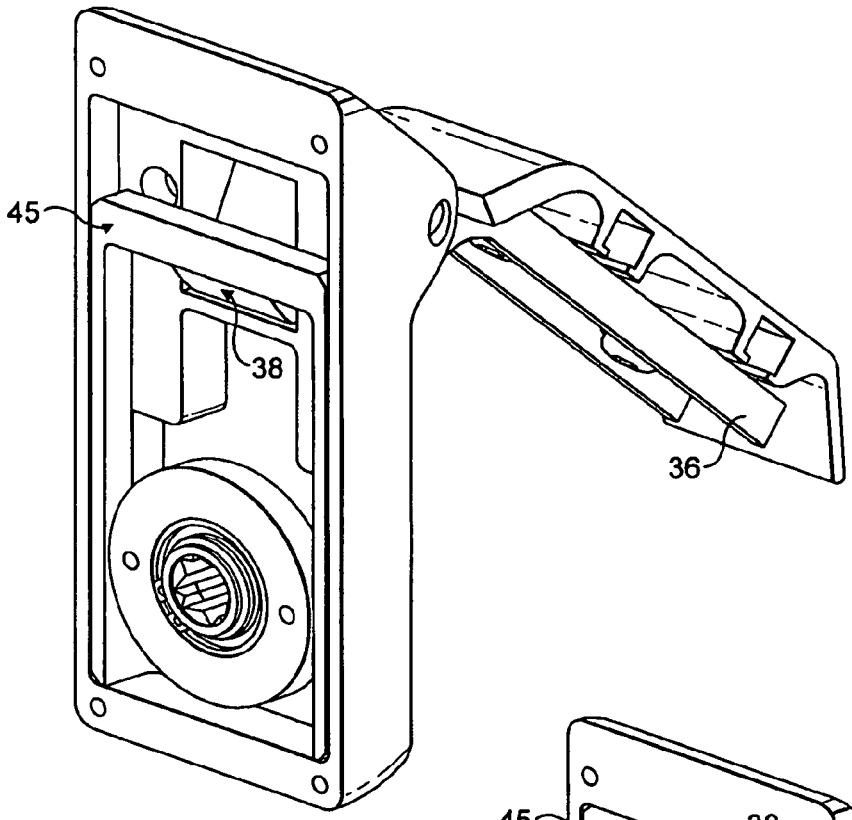
FIGS. 6*a* and 6*b* are rear perspective views of the push pad assembly (housing backplate not shown) with the push pad in the raised and lowered positions respectively.
Figure 6B:
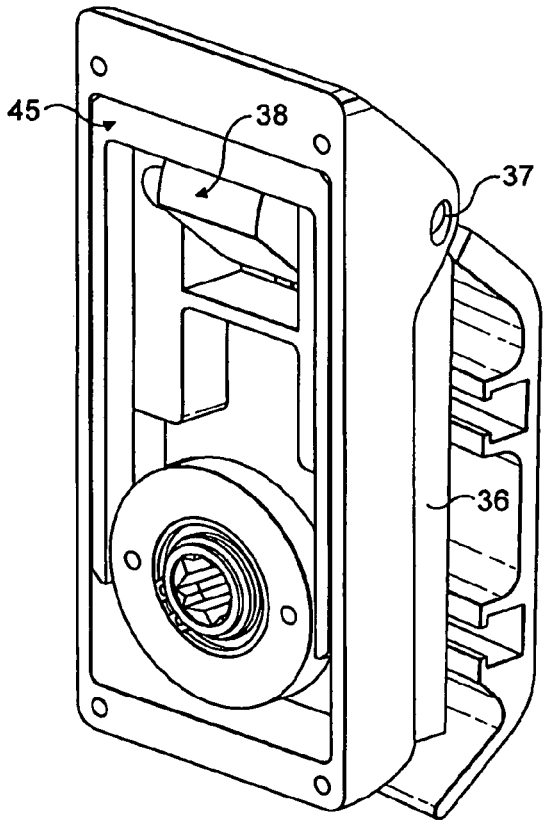

FIG. 6 shows the assembled push pad assembly 10 with the backplate 34 removed to show the internal operation of the assembly. FIG. 6*a* shows the push pad assembly 10 with the push pad 36 raised. This is the position of the push pad 36 when the bolting mechanism to which the push pad is attached is in the thrown or bolted position, for example when securing a door closed. FIG. 6*b* shows the push pad in the lowered position, such as when the push pad has been operated to release the bolting mechanism and open the door.

The operation of the push pad assembly 10 will now be described. In the raised position shown in FIG. 6*a*, the slide plate 45 is in a lowered position, and may rest on the bottom of the inside of the housing 32. This is also shown schematically in a rear plan view in FIG. 7*a*. The shoulder 38 of the push pad 36 is engaged under the top side of the slide plate. The drive cam 55 is oriented such that the aperture 58 for receiving a shaft or spindle of the bolting mechanism (not shown), is in a locked or thrown position, such as when securing a door closed. In this position, the crank pin 62 of the drive cam 55 rests on the top surface of the bottom side 46 of the slide plate 45.

In FIG. 6*b*, the push pad 36 is shown in the lowered position representing the position in which the bolting mechanism has been released. The push pad 32 has turned about the pivot 37, thereby raising the shoulder 38 of the push pad 36. As mentioned above, the slide plate 45 is engaged with the shoulder of the push pad 36. Hence, the slide plate 45 has been raised with the shoulder 38. This is also shown schematically in FIG. 7*b*. The crank pin 62, which is resting on the bottom side 46 of the slide plate, is also moved. The drive cam 55 has been rotated by the movement of the slide plate, thereby allowing the crank pin 62 to move upwards with the slide plate. Since the drive cam 55 has been rotated, the aperture 58 for holding the spindle (or shaft) of the bolt mechanism has also rotated which may thereby release the bolts and allow a door to open.

Figure 7A:
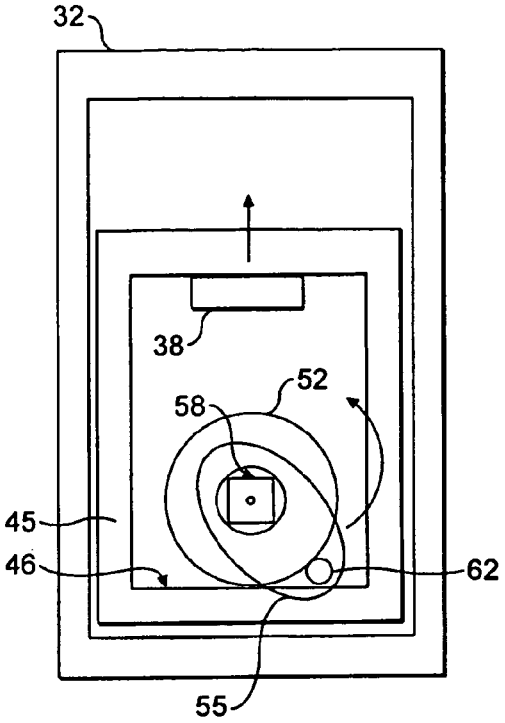
FIGS. 7*a* and 7*b* are schematic diagrams showing the movement of the drive cam and slide plate of the push pad for use on a left handed door.
Figure 7B:
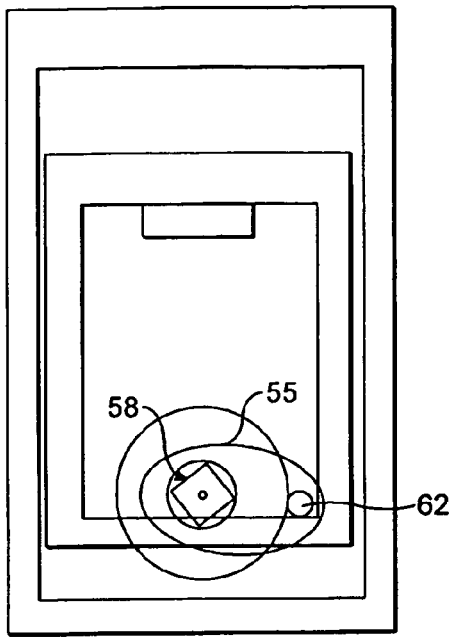

FIG. 8 shows schematically how reorienting the drive cam 55 allows the push pad assembly to be reversed. For example, if FIGS. 7*a* and 7*b* show the operation of the assembly on a left hand opening door, then by reorienting the drive cam 55 the push pad assembly may be used on a right hand opening door. This allows the push pad to be supplied as one unit that is reversible and can be fitted to either left hand or right hand opening doors by simply reorienting the cam 55. No additional or alternate components are required.

Figure 8A:
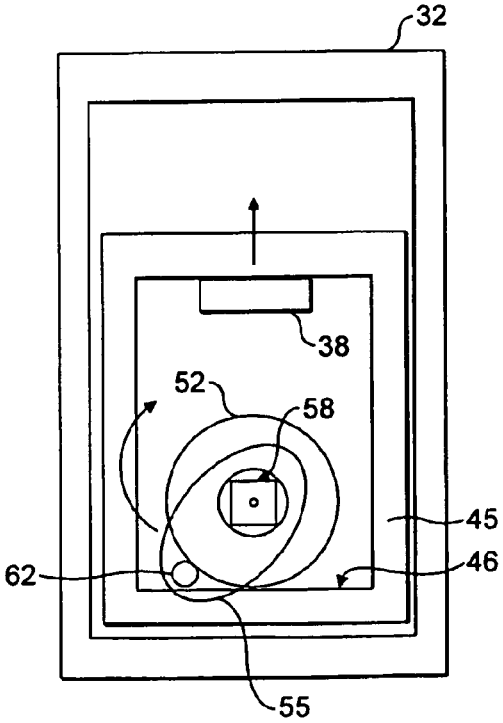
FIGS. 8*a* and 8*b* are schematic diagrams showing the movement of the drive cam and slide plate of the push pad for use on a right handed door.
Figure 8B:
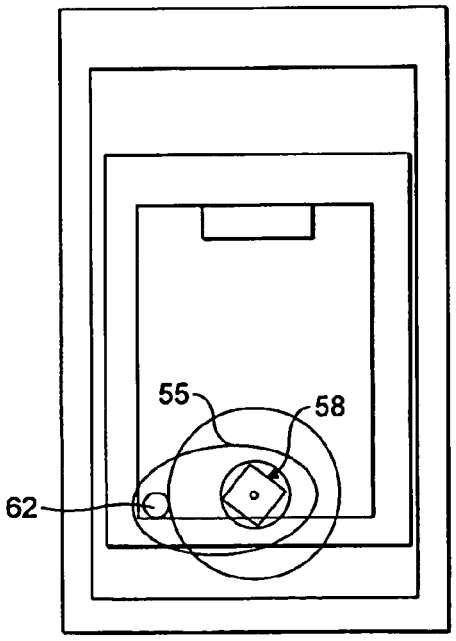

To change the operation of the push pad 10 from being suitable for operation on a left hand opening door to a right hand opening door, the drive cam 55 should be rotated from being on the right side of the aperture 58, as shown in FIGS. 7*a* and 7*b*, to be on the left side of the aperture 58, as shown in FIGS. 8*a* and 8*b*. This operation should be performed prior to fitting the push pad assembly 10 to the bolting mechanism 20. The rotation of the drive cam 55 to change from left handed to right handed operation may be achieved by inserting a spindle into the aperture 58 and turning the drive cam through between 180 and 270°. Once the rotation has been effected, the push pad assembly 10 may be fitted to the bolting mechanism 20.

Figure 9A:
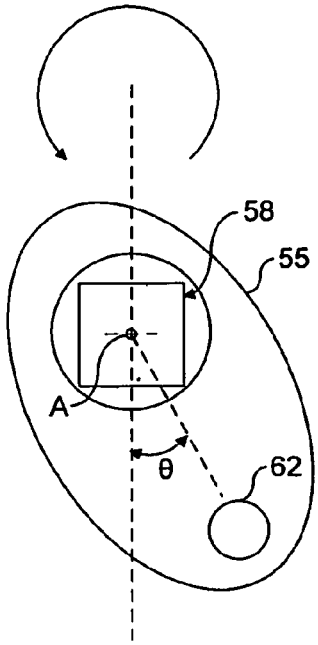
FIG. 9 is a schematic diagram showing the positions of the drive cam and aperture in the cam for left and right handed operation.
Figure 9B:
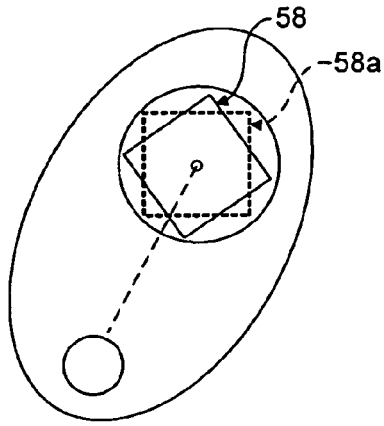

As mentioned above the aperture 58 may be comprised of two offset squares. This was shown in FIG. 5 and is also illustrated schematically in FIG. 9*b*. When fitted to the bolting mechanism 20, the spindle of the bolting mechanism may have a rest bolted (or thrown) position with the square sides of the cross-section of the spindle aligned vertically and horizontally. Hence, the aperture 58 of the drive cam 55 should be correspondingly aligned when the push pad is in the raised position. FIG. 9*a* shows schematically the orientation of the drive cam 55 and aperture 58 for a left hand opening door. As mentioned above, rotation of the drive cam 55 by between 180 and 270° (about axis A) converts the push pad assembly operation to that for a right hand opening door. However, as shown in FIG. 9*b*, this rotation may result in the aperture 58 now being at angle to the vertical and horizontal. If the spindle for the left hand opening door also requires the square aperture to be aligned vertical and horizontal, then the aperture is in the wrong position. To overcome this effect, the aperture comprises a second square 58*a* offset by an angle to the first, as shown in FIG. 9*b*. The angular offset between the two squares 58 and 58*a* is determined by the starting position of the cam at the two positions shown in FIGS. 9*a* and 9*b*. The angular offset will be 2θ, where θ is the angle between the start position (that is the position of the drive cam with the push pad 36 raised) and the vertical. In some case, this will be 45°, in other cases a different offset will be used.

The above described push pad assembly 10 also has an advantage in that the amount of rotation of the drive cam and hence, the spindle of the bolting mechanism, is increased over prior art devices. In particular, for movement of the push pad 32 from the raised position to the lowered position, the push pad rotates by a given angle about its pivot 37. In the above described embodiments, the resulting amount of rotation of the drive cam is greater than the amount of rotation of the push pad. For example, a 45° rotation of the push pad from the raised position to the lowered position results in a 57° rotation of the drive cam 55 and the spindle of the bolting mechanism. For other embodiments, the amount of rotation of the drive cam may be changed by adjusting the relative position of the crank pin. For example, for the same movement of the slide plate, a crank pin located closer to the crank rotation axis may achieve increased rotation of the drive cam 55.

Once the door has been released the push bar 36 will be returned to its raised position by the spring loading of the bolting mechanism.

The above described embodiments may incorporate three different bearings: sleeve bearing 38 used between the pin 37 and housing 32 to reduce friction during the rotation of the push pad 36; bearing assembly 50 for smooth rotation of the drive cam 55 and spindle; and bearings to allow rotation of the outer surface of the crank pin 62 as it moves against the slide plate 45. The effect of these bearings is to reduce friction and improve the lifetime of the push pad assembly. Moreover, the combination of the reduced friction, and the effect of greater rotation of the bolt spindle for a given movement of the push pad means the embodiments described are easier to use by the disabled, elderly and children. The above described embodiments have a release pressure significantly below European standards for such devices.

Figure 10:
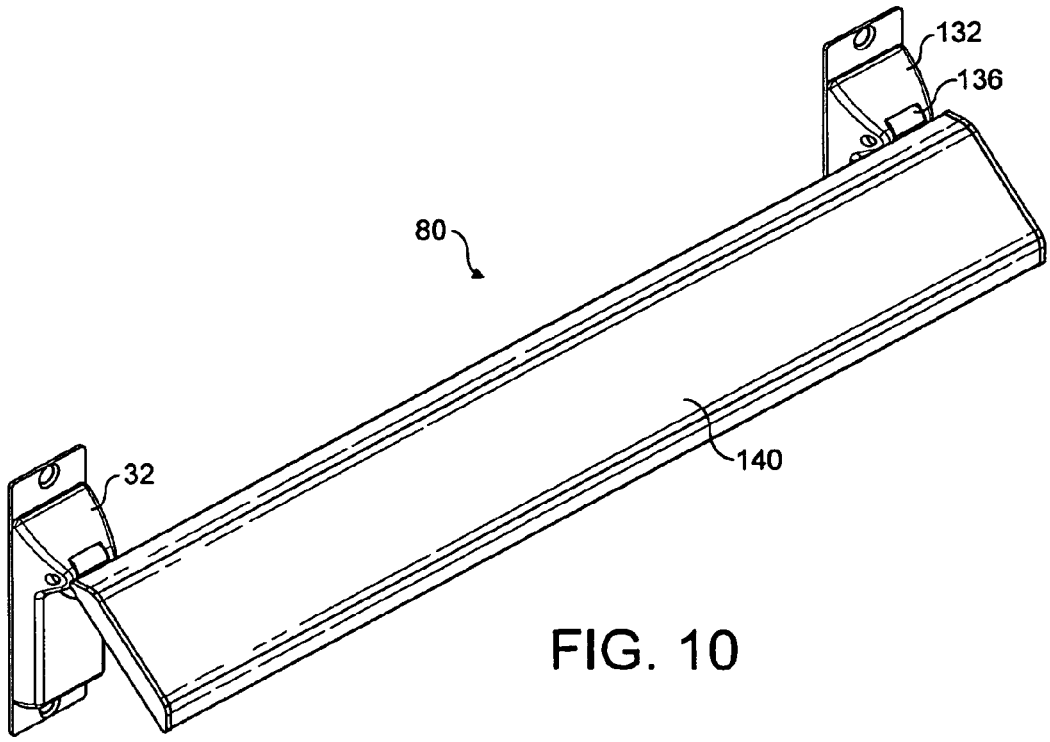
FIG. 10 is a perspective view of a panic bar assembly of the present invention.

FIG. 10 shows a panic bar assembly 80. The mechanism and operation of the panic bar assembly 80 is very similar to that of the push pad assembly 10. The panic bar assembly 140 comprises two housings 32 and 132. The housing 32 and components contained therein are the same as for the push pad assembly 10. The second housing 132 is provided at a distance from the first housing 32. The second housing also comprises a push pad 136. The two push pads are linked by bar 140. The second housing 132 may contain another set of the components contained in the first housing 32. Alternatively, since the first housing contains the mechanism that will be used to drive the bolting mechanism 20, the second housing 132 and second push pad 136 may merely support the distal end of the bar.

When fixed to the bolting mechanism on a door or other opening, the first housing is fitted directly to the bolting mechanism. The second housing 132 will be fitted toward the opposing side of the same face of the door. The second housing 132 will require a spacer between it and the door to match the thickness of the bolting mechanism to which the first housing is fitted to. The spacer will maintain the bar 140 an even distance from the door along the length of the bar.

The panic bar assembly 80 may be reconfigured to operate on a left or right hand opening door in the same manner described above for the push bar assembly. Additionally, the relative positions of the first housing and second housing must be swapped to ensure the first housing 32 (containing the operating mechanism) is on the correct side of the door for the bolting mechanism. This can be done by removing the fixings holding the bar 140 to the push pads 32 and 132 and swapping the push bar assemblies over.

The person skilled in the art will readily appreciate that various modifications and alterations may be made to the above described push pad and panic bar assemblies without departing from the scope of the appended claims, for example, different bolting mechanisms may be used, such as a single point bolting mechanism, or the bolting mechanism may be on a different leaf to an emergency exit door. Variations in the actual shapes of the parts such as the cam and shaft/spindle may also be made without diverging from the general scope of the present invention.

The invention claimed is:

1. A push plate assembly for rotationally driving a bolt mechanism, the push plate assembly comprising:

a housing and a backplate;

a push plate rotatably coupled to the housing so as to rotate when pushed towards the housing;

a slide plate mounted within the housing to slide when driven by rotation of the push plate; and a drive cam having a cam lobe, and a crank pin mounted on the cam lobe, the drive cam arranged to rotate within the housing when driven by the slide plate so as to drive the bolt mechanism, wherein the slide plate is formed as a rectangular ring, and the drive cam is coupled to the backplate by a bearing assembly within the aperture of the rectangular ring, and the drive cam is arranged to rotate within the aperture of the slide plate, and the crank pin is arranged to bear upon a horizontal cammed surface of the aperture within the slide plate, wherein the push plate assembly is adapted to be reversible for operation on lefthand and righthand opening doors, without disassembly of the push plate assembly, by reorientation of the drive cam within the aperture of the slide plate such that when driven by the push plate to retract a bolt of the bolt mechanism, the direction of rotation of the drive cam before reorientation is opposite to that after reorientation, thereby reversing the drive rotation direction to retract the bolt.

2. The push plate assembly of claim 1, wherein the push plate comprises a tang adapted to bear against a surface of the slide plate so as to drive the slide plate upon rotation of the push plate.

3. The push plate assembly of claim 1, wherein the rotation axis of the drive cam is perpendicular to the direction of sliding of the slide plate.

4. The push plate assembly of claim 1, wherein the rotation axis of the drive cam passes through the aperture of the slide plate.

5. The push plate assembly of claim 1, wherein the rotation of the push plate is about an axis substantially perpendicular to the axis of rotation of the drive cam.

6. The push plate assembly of claim 1, wherein the push plate is hinged by a pin passing through one or more apertures in each of the housing and the push plate.

7. The push plate assembly of claim 1, wherein the drive cam includes an aperture adapted to receive a shaft for driving the bolt mechanism.

8. The push plate assembly of claim 7, wherein the aperture is adapted to receive the shaft at two orientations, the two orientations arranged for reversible driving of the bolt mechanism.

9. The push plate assembly of claim 8, wherein the aperture comprises two square apertures offset by an angle about the rotation axis of the drive cam.

10. The push plate assembly of claim 1, wherein the push plate is rotatably coupled to the housing by a pivot comprising a first bearing.

11. The push plate assembly of claim 10, wherein the first bearing is a sleeve bearing.

12. The push plate assembly of claim 1, wherein a crank pin is coupled to the drive cam, the crank pin is arranged to bear upon the cammed surface of the slide plate so as to be driven by the slide plate to rotate the drive cam.

13. The push plate assembly of claim 12, wherein the crank pin is rotatably coupled to the drive cam.

14. The push plate assembly of claim 1, wherein less than 45° rotation of the push plate provides greater than 45° of rotation of a shaft of the bolt mechanism.

15. The push plate assembly of claim 1, further comprising a cover plate attached to the push plate.

16. The push plate assembly of claim 1, further comprising the bolt mechanism.

17. The push plate assembly of claim 16, wherein the bolt mechanism comprises one or more bolts slideable from a thrown position to a retracted position by pressing the push plate.

18. The push plate assembly of claim 1, wherein the bottom of the rectangular ring of the slide plate extends out of a plane of the ring.

19. The push plate assembly of claim 1, wherein before and after reorientation for reversible operation, the drive cam bears against different portions of the cammed surface of the aperture within the slide plate.

20. The push plate assembly of claim 18, wherein the cammed surface of the aperture within the slide plate is an upper surface of the bottom of the rectangular ring which extends out of the plane of the ring.

21. The push plate assembly of claim 1, wherein rotation of the drive cam by 180-270° reorients the drive cam for operation with a reversed rotation direction when driven by the push plate to retract the bolt.

22. The push plate assembly of claim 1, wherein the horizontal cammed surface is orthogonal to the slide direction of the slide plate.

23. A panic bar assembly comprising the push plate assembly of claim 1, and further comprising a second housing comprising a second push plate linked to the first push plate by a bar.

24. A leaf within a frame comprising the bolt mechanism coupled to be driven by the push plate assembly of claim 1 to secure the leaf within the frame.

25. The leaf of claim 24, wherein the push plate assembly and bolt mechanism are mounted on the leaf.

* * * * *